US006663311B1

(12) United States Patent
Ong

(10) Patent No.: US 6,663,311 B1
(45) Date of Patent: Dec. 16, 2003

(54) REPORT COVER WITH CLAMPING SLIDE BAR

(76) Inventor: Bon S. Ong, Box 4247, Torrance, CA (US) 90510

( * ) Notice: Subject to any disclaimer, the term of this patent is extended or adjusted under 35 U.S.C. 154(b) by 0 days.

(21) Appl. No.: 10/161,897

(22) Filed: Jun. 5, 2002

(51) Int. Cl.[7] ..... B42F 3/02

(52) U.S. Cl. ..... 402/19; 281/15.1; 281/21.1; 281/36; 402/8; 402/73

(58) Field of Search ..... 281/15.1, 21.1, 281/17, 18, 19.1, 27.1, 28, 29, 36, 37, 38, 45; 402/8, 17, 18, 19, 45, 46, 73, 74, 79, 80 R, 80 P, 500, 502

(56) References Cited

U.S. PATENT DOCUMENTS

| | | | | | |
|---|---|---|---|---|---|
| 4,486,032 | A | * | 12/1984 | Leahy | 281/46 |
| 5,503,487 | A | * | 4/1996 | Ong | 402/79 |
| 5,865,469 | A | | 2/1999 | Chin | |
| 5,947,524 | A | * | 9/1999 | Podosek | 281/45 |
| 6,074,094 | A | * | 6/2000 | Manolizi et al. | 383/5 |
| 6,270,120 | B1 | | 8/2001 | Ong | |
| 6,371,520 | B1 | * | 4/2002 | Wolff et al. | 281/29 |

* cited by examiner

*Primary Examiner*—Monica Carter
(74) *Attorney, Agent, or Firm*—Charles H. Thomas

(57) ABSTRACT

A document formed of a stack of papers bound at the spine is equipped with a slide bar that achieves locking engagement with a document cover formed of a plurality of sheets of material. The sheets of document cover material are joined to each other at a binding margin. The sheet of cover material that passes around the spine of the cover forms a back cover beneath the stack of papers and a narrow, margin panel or strip that overlies the adjacent edge of the other sheet of binding material, which forms a front cover. The slide bar has a pair of jaws that terminate in distal tips that face each other at an angle of least forty-five degrees across a gap defined between the distal tips of the jaws. The slide bar is inserted onto the binding edge of the stack of papers and the cover encompassing them in a direction parallel to the binding edge from either the top or bottom end of the stack. The narrow margin panel atop the binding edge margin or the stack of papers fits within and is captured by the distal tip of one of the clasp jaws adjacent thereto throughout its length and throughout the length of the binding edge of the stack of papers. The capture of the narrow binding margin panel by the distal tip of the clasp jaw engaged at the junction between the sheets of the material forming the binder prevents the slide bar from being pulled laterally off of the binding edge of the stack.

20 Claims, 5 Drawing Sheets

REPORT COVER WITH CLAMPING SLIDE BAR

BACKGROUND OF THE INVENTION

1. Field of the Invention

The present invention relates to a locking slide bar or clasp of the type used to form a stiff spine for reports, sales or marketing presentations, and other stacks of paper assembled and bound together.

2. Description of the Prior Art

Plastic spines or slide bars for use in gripping the binding edges of stacks of papers together, such as reports, proposals, briefs, and other stacks of documents fastened together along a common edge have been manufactured for many years. Conventional report cover grips or slide bars of this type are manufactured as extruded plastic structures of uniform cross section throughout. Conventional slide grips are formed with a pair of jaws joined together at a common base and forming an open slot or gap therebetween. The jaws are longitudinally elongated so as to extend the entire length of the binding edge of the stack of papers. The gap between the jaws is narrow enough so that they must be forced apart slightly to accommodate the thickness of the stack of papers. The jaws can be deflected resiliently apart to increase the width of the gap therebetween so as to receive the binding edge of the stack of papers within the gap. When the jaws are released, a clamping force is exerted by the jaws against the stack of papers as the jaws attempt to move toward each other back toward their undeformed positions.

A major problem with conventional slide grips or slide bars of this type is that the gripping force is frequently inadequate to secure the grip on the binding edge of the stack of papers. Quite often, when a user opens the report, the stress of parting the papers as the pages are opened is transmitted to the slide grip as a force directed outwardly away from the longitudinally oriented binding edge of the report in a direction perpendicular thereto. As a consequence, the slide grip is pushed laterally away from the binding edge and pops off the binding of the report. This tendency is aggravated when the report has a clear, slick, glossy cover, such as a clear plastic polypropylene cover of the type frequently used as a report or presentation cover to protect the papers therewithin. The low coefficient of friction on the surface of such a plastic cover makes it extremely easy for a conventional spine-gripping bar to pop off of the binding edge of a stack of bound papers when the pages are opened.

Attempts have been made to correct this problem. For example, the otherwise conventional sliding bar report cover grip sold by the JM Company located in Hasbrouck Heights, N.J. has a report cover gripping bar provided with a pair of opposing longitudinal ribs directed toward each other near the bases of the jaws of the grip. The concept is that the additional contact with the cover provided by the ribs will enhance the gripping force provided by the slide bar on the cover. However, this system provides no positive interlocking connection between the slide bar and the report cover so that the report cover grip still slides free from the cover when the report is opened.

The Avery Dennison Company has used a gripping report cover slide bar on which the extremities of the jaws are provided with inwardly directed hooks or tangs. This system is described in U.S. Pat. No. 5,865,469. A polyethylene plastic report cover is folded in half and die cut near its longitudinal center fold with a plurality of arcuate, semicircular die cuts spaced periodically along its length to create a number of tabs. The curved surfaces of the semicircular tabs are directed away from the binding center fold and toward the opposite edges of the cover and of the stack of papers encompassed therewithin. However, this system still has several problems. Because the semicircular tabs lie in the same plane as the cover sheet material from which they are cut, the hooked edges of the gripping bar will sometimes fail to engage the semicircular tabs. Also, the die cuts are through both the front and back cover of the folded polyethylene cover sheet and must be spaced quite closely to the center fold line in order to be engaged by the hooks or tangs at the extremities of the jaws of the gripping bar. There is very little structure left between the front and back die cuts adjacent the fold line. As a consequence, the material can fail at the fold line and the tabs will separate from the remaining structure of the cover as generally circular die cut punch outs.

To solve these and other problems I previously devised a different system for creating a spine for a report or other stack of papers. This system is described in my prior U.S. Pat. No. 6,270,120, which is hereby incorporated by reference in its entirety. Specifically, in that system I utilize a slide bar that has a pair of jaws that terminate in hooked lips that face each other across a gap defined between the jaws. The narrow margin panel atop the binding edge of the report is captured by the hooked lip of one of the jaws throughout its length. The positive locking interengagement of the narrow binding margin panel in the hooked lip prevents the slide bar from being pulled laterally off of the binding edge of the stack. While this system works quite successfully, it's still involves the necessary step of securing the binder to the stack of papers by means of fasteners, such as staples. This involves an extra step in the preparation of reports and other documents. Where many copies of such documents are required, this extra step adds considerably to the time and expense involved in preparing bound reports and other documents for distribution.

SUMMARY OF THE INVENTION

The present invention is an improved type of document binding cover grip bar system that overcomes the deficiencies of the prior art. Specifically, I have discovered that by configuring the jaws of the slide bar so as to more directly oppose each other to form a clamp, the clasp created exerts such a firm grip on the binding and stack of papers enclosed therewithin that it is no longer necessary for the cover to be fastened to the stack of papers encompassed therebetween by any other fasteners. Moreover, with the proper orientation of the jaws, it is unnecessary to provide the distal tips of the jaws with hooked lips in order to capture both the cover and the stack of papers encompassed therebetween even without the use of other fasteners, such as staples.

By orientating the distal tips of the clamping jaws of the slide bar in direct opposition to each other at an angle of no less than about forty-five degrees, a slide bar constructed according to the present invention firmly grips a narrow margin binding panel or strip of a cover, as well as a stack of papers located within the cover, without the use of any other type of fastening system. The clamping slide bar of the present invention prevents the papers within a stack of papers folded within a document cover from pulling free from the cover and does not require a separate die cutting operation to create tabs from the cover for the clamping jaws to grip. Furthermore, the system of the present invention is not susceptible to structural failure within a plastic cover, since there are no tabs cut into the structure of the cover.

In one broad aspect the present invention may be considered to be a combination of a plurality of sheets of paper, a document cover, and a stiff, resilient, elongated channel-shaped clasp which engages the document cover. The sheets of paper are disposed one atop another to form a stack having top and bottom sheets and defining a binding edge of the stack. An opposite edge of the stack is parallel to the binding edge while a narrow binding margin on the stack lies adjacent to the binding edge. The document cover is formed of a plurality of panels, including a front cover panel located atop the stack and above the top sheet and a back cover panel located beneath the stack and residing below the bottom sheet of the stack and having a margin portion located beneath the binding margin. Another of the document cover panels is a narrow margin binding panel having a width no greater than the width of the binding margin of the stack. The front cover panel is formed of a separate sheet of material from the back cover panel and the narrow margin binding panel and overlaps and is permanently secured to the narrow margin binding panel.

The channel-shaped clasp is of uniform cross section throughout and is formed with a pair of jaws joined together and projecting outwardly from their junction to form distal tips that define a gap therebetween. The jaws are oriented in opposition relative to each other. The distal tips are directed toward each other to form an angle therebetween of at least about forty-five degrees. The binding edge of the stack, the narrow margin binding panel, and the margin portion of the back cover panel are inserted in between the jaws with the remainder of the stack and document cover projecting through the gap so that the distal tip of one of the jaws is engaged with the narrow margin binding panel to restrict relative movement between the clasp and the stack in a direction perpendicular to the binding edge.

Preferably, the jaws of the clamp are oriented relative to each other at an angle of about ninety degrees, and the gap between the distal tips of the jaws has a width of no greater than about fifty mils when the clasp is in an undeformed condition. The front cover panel is formed of a separate, first sheet of material while the other binding panels are formed of a second, separate sheet of material. The back cover panel is a broad back cover that extends from the binding edge of the stack all the way across to the opposite edge of the stack beneath the bottom sheet thereof and is separated from the narrow margin binding panel by at least one fold at the spine of the binder. With a construction such is this, the back cover panel and the narrow margin binding panel of the document binder may be formed of paper, card stock, or plastic, such as polyethylene or polypropylene. A separate, clear, transparent polyethylene sheet may serve as a front cover panel for the cover and may be attached to the underside of the narrow margin binding panel by adhesive or sonic welding above the binding margin of the stack of papers. Alternatively, the front cover may be constructed of some other plastic, such as polypropylene or Mylar, or it may be constructed of paper or card stock as well.

The invention may be defined in another way as a combination of a plurality of pages, a cover, and a stiff, resilient, elongated clasp of uniform cross section throughout. The pages are disposed one atop another to form a stack having top and bottom sheets and defining a binding edge of the stack. An opposite edge of the stack is parallel to the binding edge. The stack has a narrow binding margin adjacent to the binding edge. The cover for the stack includes a first sheet of material forming a margin panel and a back cover panel respectively residing in contact with the top and bottom sheets of the stack. The cover panels of the first sheet of binding material are joined together by at least one spine fold located at and parallel to the binding edge of the stack. The narrow margin panel has an exposed side and an underside that extends the length of the binding margin and is limited in width so that it extends no further toward the opposite edge of the stack than the binding margin. The narrow margin panel thereby defines an inboard boundary proximate the binding margin. The second sheet of cover material forms a front cover panel that is permanently secured to the underside of the narrow margin panel.

The clasp is formed as a channel-shaped structure having a pair of opposing jaws that have mutually facing distal tips oriented in opposition relative to each other and which form an angle therebetween of at least about forty-five degrees. The distal tips of the jaws also define a slot opening therebetween. The distal tip of one of the jaws is disposed to capture the cover therewithin, whereby the distal tip of one of the jaws engages the inboard boundary of the margin panel. The clasp is thereby held on the binding edge of the stack.

The invention may be described with greater clarity and particularity by reference to the accompanying drawings.

DESCRIPTION OF THE EMBODIMENTS

Figure 1:
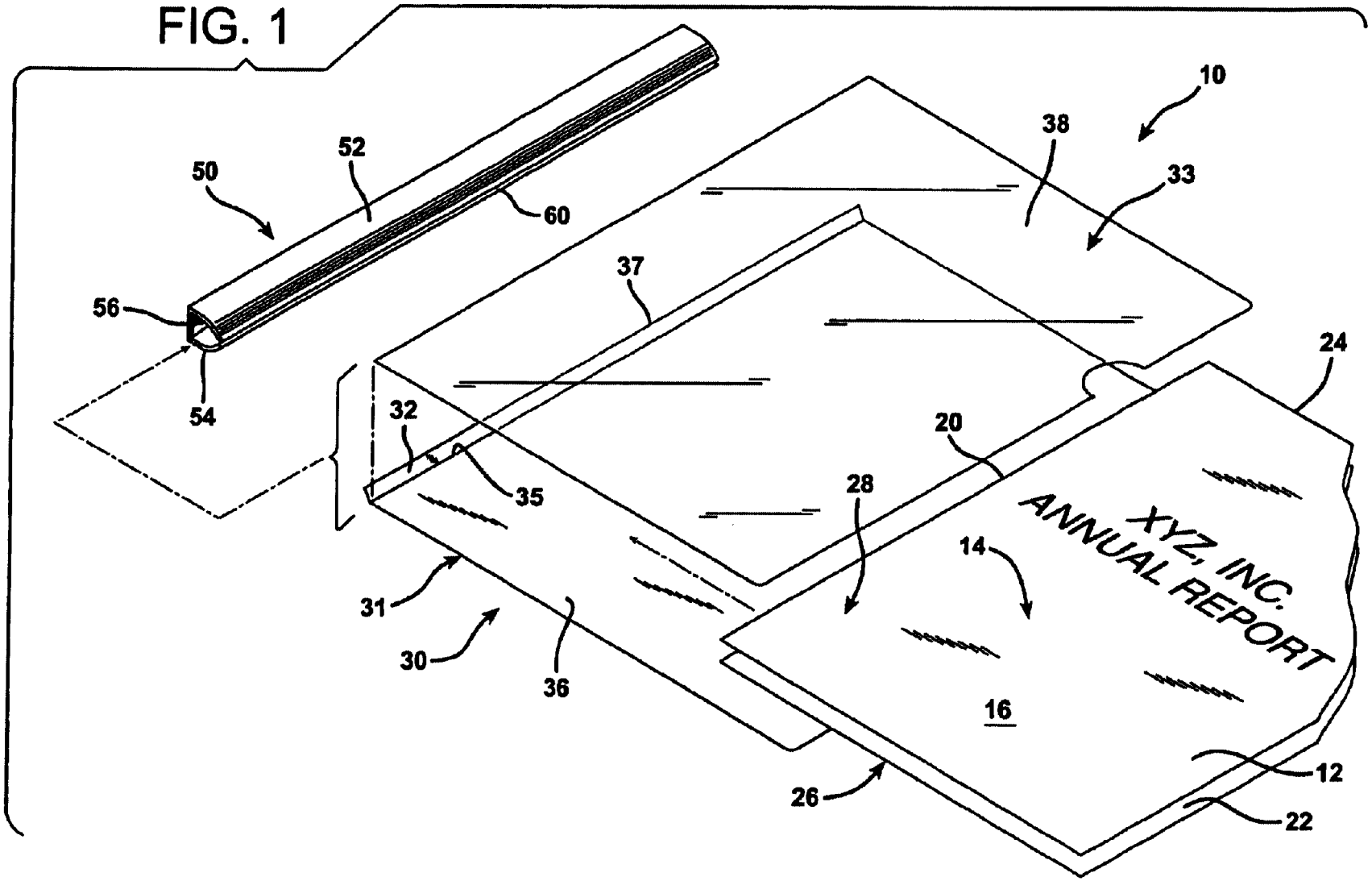
FIG. 1 is an exploded perspective view illustrating one preferred embodiment of a locking slide bar document binding system according to the invention.
Figure 2:
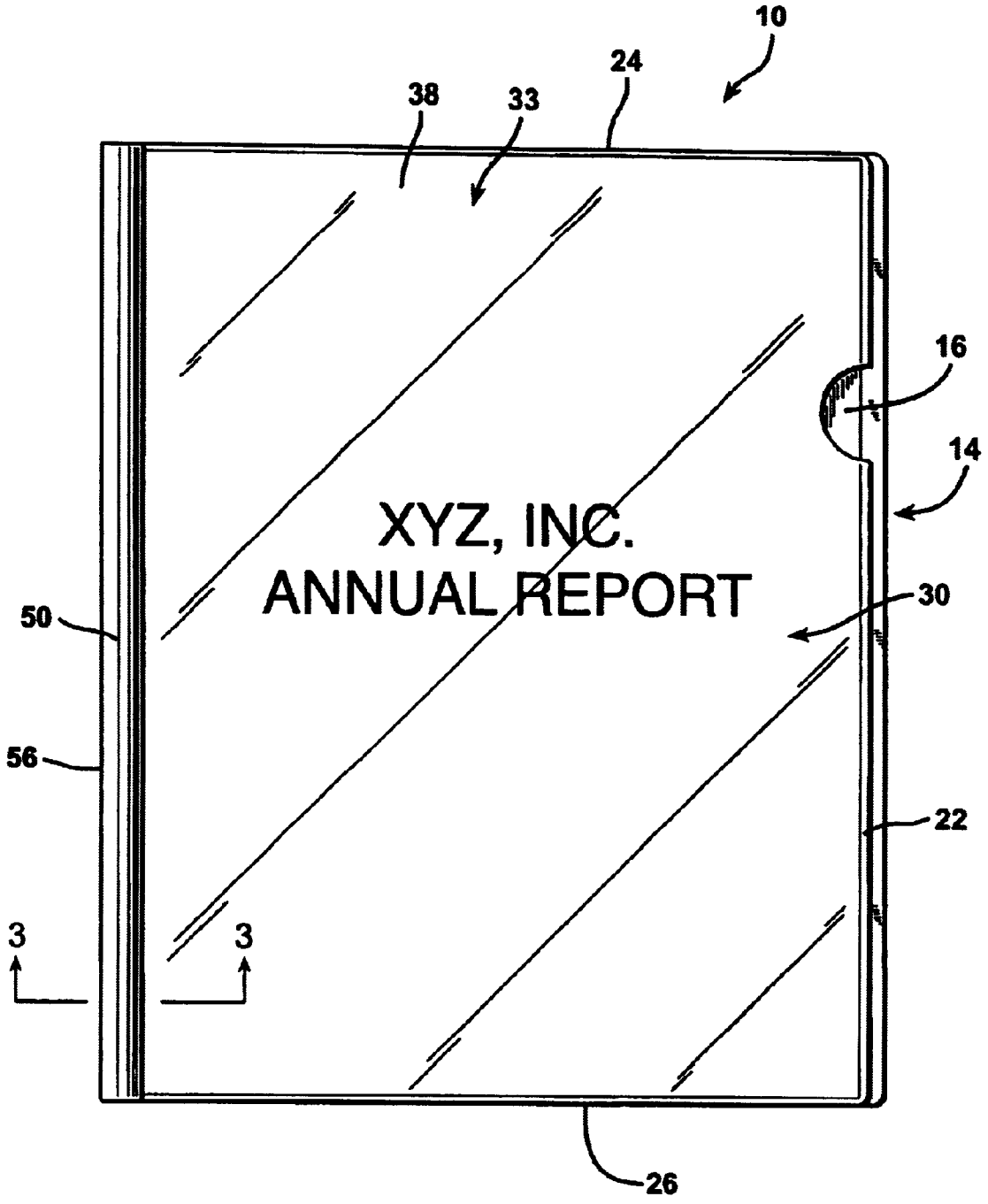
FIG. 2 is a top plan view illustrating the components of the document binding system of FIG. 1 assembled together.
Figure 3:
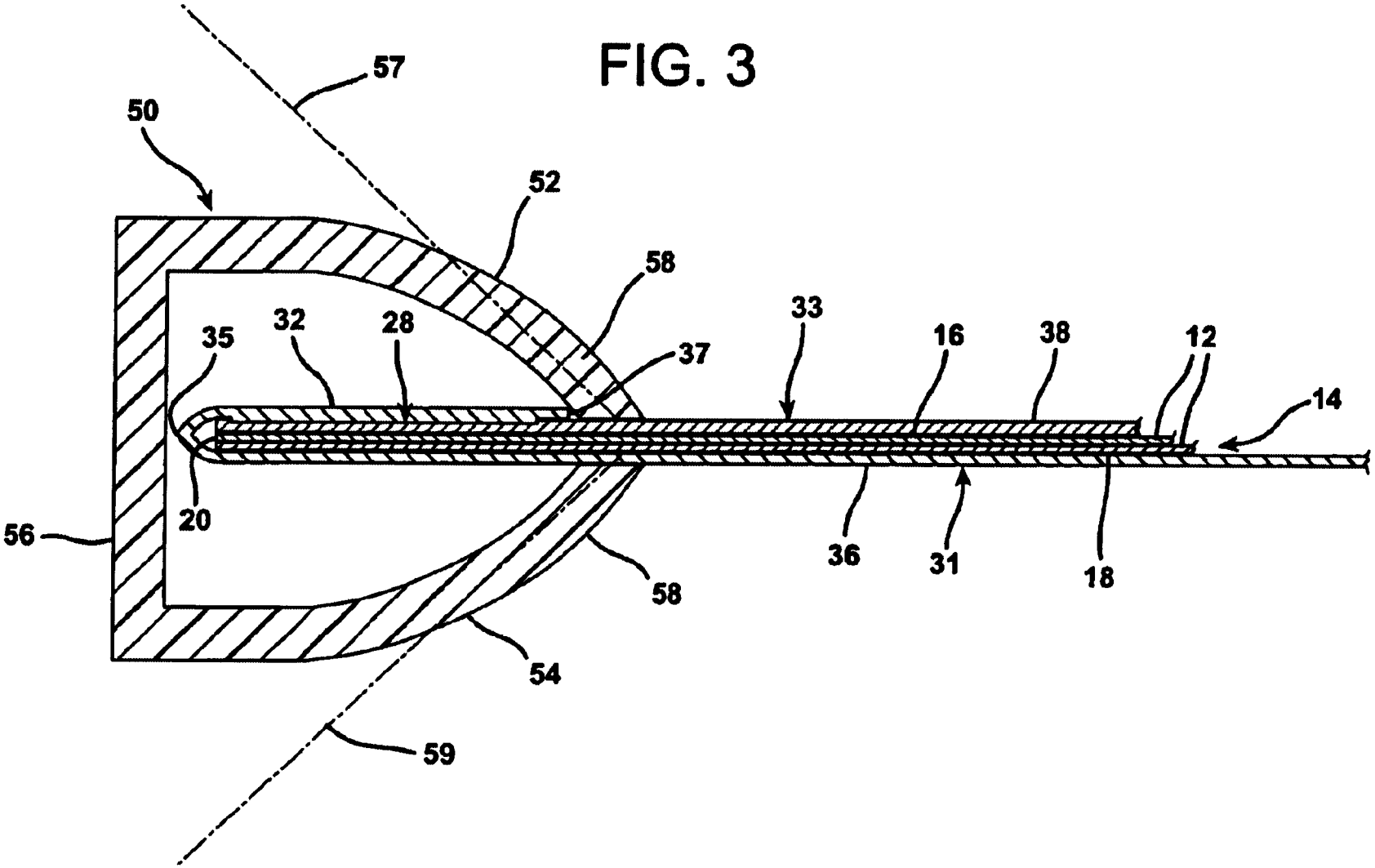
FIG. 3 is a sectional elevational detail taken along the lines 3—3 of FIG. 2.

FIGS. 1, 2, and 3 illustrate the combination of the invention generally at 10. The combination 10 is comprised of a plurality of rectangular sheets of paper 12 disposed one atop another to form a stack of papers indicated generally at 14. The paper sheets 12 may have, for example, a width of eight and one-half inches and a length of eleven inches. The paper stack 14 has a top sheet 16 and a bottom sheet 18. For simplicity of illustration of the stack of papers 14 is shown with only a top sheet 16 and bottom sheet 18, although there may be a very considerable number of additional sheets 12 interposed therebetween.

The stack of papers 14 defines a binding edge indicated at 20 and an opposite edge 22 which is parallel to the binding edge 20. The paper stack 14 also has an upper edge 24 and an opposite lower edge 26. The stack 14 also defines a narrow binding margin 28 which may, for example, be about one-half an inch in width. The binding margin 28 is adjacent to the binding edge 20 of the stack 14.

The combination 10 also includes a document cover 30 formed of a first sheet 31 which may be of heavy paper or card stock and a second sheet 33 which may be formed of polypropylene. The cover 30 is formed of a plurality of panels, including a narrow margin binding panel 32 and a broad bottom back cover panel 36 which are both formed from the first card stock sheet 31, and a top front cover panel 38 formed from the second polypropylene plastic sheet 33.

The narrow top binding margin panel 32 is a strip only about one-half of an inch wide and is delineated from the back cover panel 36 by a linear spine fold 35. The narrow binding margin panel 32 is folded over the inner, binding edge of the back cover 36 and is located above the top sheet 16 of the stack of papers 14. The inner margin 28 of the stack 14 adjacent the inner edge of the top front cover panel 38 lies beneath the narrow binding margin panel 32, which overlaps it from above. The inner margin of the top front cover panel 38 is secured to the underside of the narrow binding margin panel 32 by adhesive, heat sealing, and/or sonic welding throughout its length. The edge 37 of the narrow binding margin panel 32 that resides atop the top front cover binding panel 38 forms a boundary demarcation of overlap where the first and second binding sheets 31 and 33 are joined together.

The top front cover panel 38 resides in contact throughout with the top sheet 16 in the paper stack 14 throughout the binding margin 28 of the stack 14. The broad bottom back cover panel 36 extends from the binding edge 20 of the stack 14 all the way across to the opposite edge 22 of the stack 14 beneath the bottom sheet 18 of the stack of papers 14.

The top binding margin panel 32 is limited in width so that its edge 37 extends no further toward the opposite edge 22 of the stack 14 than the binding margin 28. The inboard boundary of the top binding margin panel 32 is formed by the edge 37 where the inner binding margin panel 32 terminates atop the top front cover panel 38 proximate the binding margin 28 of the stack 14. The edge 37 of the narrow binding margin panel 32 resides only about one-half an inch from the binding edge 20 of the stack 14.

The combination 10 also employs a stiff, resilient, elongated clasp 50 which may be formed as an extrusion of polypropylene, polyvinyl chloride, or another plastic which is cut to length. The clasp 50 is configured with a pair of opposing jaws 52 and 54 that are joined together at their respective bases by a narrow, rectangular spine strip 56. The spine strip 56 has a width greater than that of the thickness of the stack of papers 14 and thereby spans the distance between the top sheet 16 and the bottom sheet 18 of the stack of papers 14. The jaws 52 and 54 join the spine strip 56 and project outwardly therefrom . Both jaws 52 and 54 terminate in distal tips 58 which are directed toward and face each other across the slot opening 60 defined between them, as best illustrated in FIG. 3. As shown in FIG. 3, the distal tips 58 of the jaws 52 and 54 are oriented roughly in planes 57 and 59 and thereby reside at an angle relative to each other of at least forty-five degrees, and preferably about ninety degrees as illustrated. The gap or slot opening 60 defined between the distal tips 58 of the jaws 52 and 54 is preferably no greater than about fifty mils in width. The width of the spine strip 56 is at least ten times as great as the width of the slot opening 60 so as to maintain the distal tips 58 of the jaws 52 and 54 oriented in clamping opposition toward each other to form an angle of at least forty-five degrees. Preferably, the spine strip 56 has a width of about three-eighths of an inch.

FIG. 1 illustrates the manner of assembly of the clasp 50 with the stack of papers 14 forming a business report in which the report cover 30 envelops the stack of papers 14 without any fastening means other than the elongated clasp 50 to create the combination 10. The structure forming the cover 30 is folded along the return fold line 35 so that the narrow binding margin panel 32 and the top front cover binding panel 38 lie atop the top sheet 16 and the stack of papers 14. The edge 37 of the narrow binding margin panel 32 furthest from the margin edge 20 of the stack of papers 14 creates a demarcation or boundary edge to the narrow top cover panel 32. The clasp 50 is positioned near either the top edge 24 or the bottom edge 26 of the stack papers 14. The jaws 52 and 54 of the clasp 50 are then flexed slightly apart, if necessary, adjacent the end of the stack 14 at which the clasp 50 is to be inserted over the cover 30 and stack of papers 14 and enveloped therewithin.

The clasp 50 is then pushed along the binding edge 20 of the stack 14 in a direction parallel thereto, whereupon the boundary demarcation edge 37 of the narrow binding margin panel 32 is engaged by the distal tip 58 of the upper jaw 52, as illustrated in FIG. 3. The clasp 50 is then pushed all the way along the length of the stack 14 so that the ends of the clasp 50 are in registration with the top and bottom edges 24 and 26 of the stack 14. When assembled in this manner the clasp 50 is firmly engaged with the cover 30 by virtue of the clamping force of the jaws 52 and 54 toward each other and the interengagement of the demarcation edge 37 of the narrow, top cover panel 32 by the distal tip 58 of the upper jaw 52 of the clasp 50.

The clasp 50 will resist separation from the cover 30 and stack 14 even though a significant lateral or transverse force of separation is applied against the clasp 50 toward and perpendicular to the longitudinal binding edge 20 of the stack 14. This strong resistence is due to the clamping force of the jaws 52 and 54 of the clasp 50 and by the engagement of the boundary demarcation edge 37 of the narrow binding margin panel 32 by the distal tip 58 of the upper jaw 52.

Figure 4:
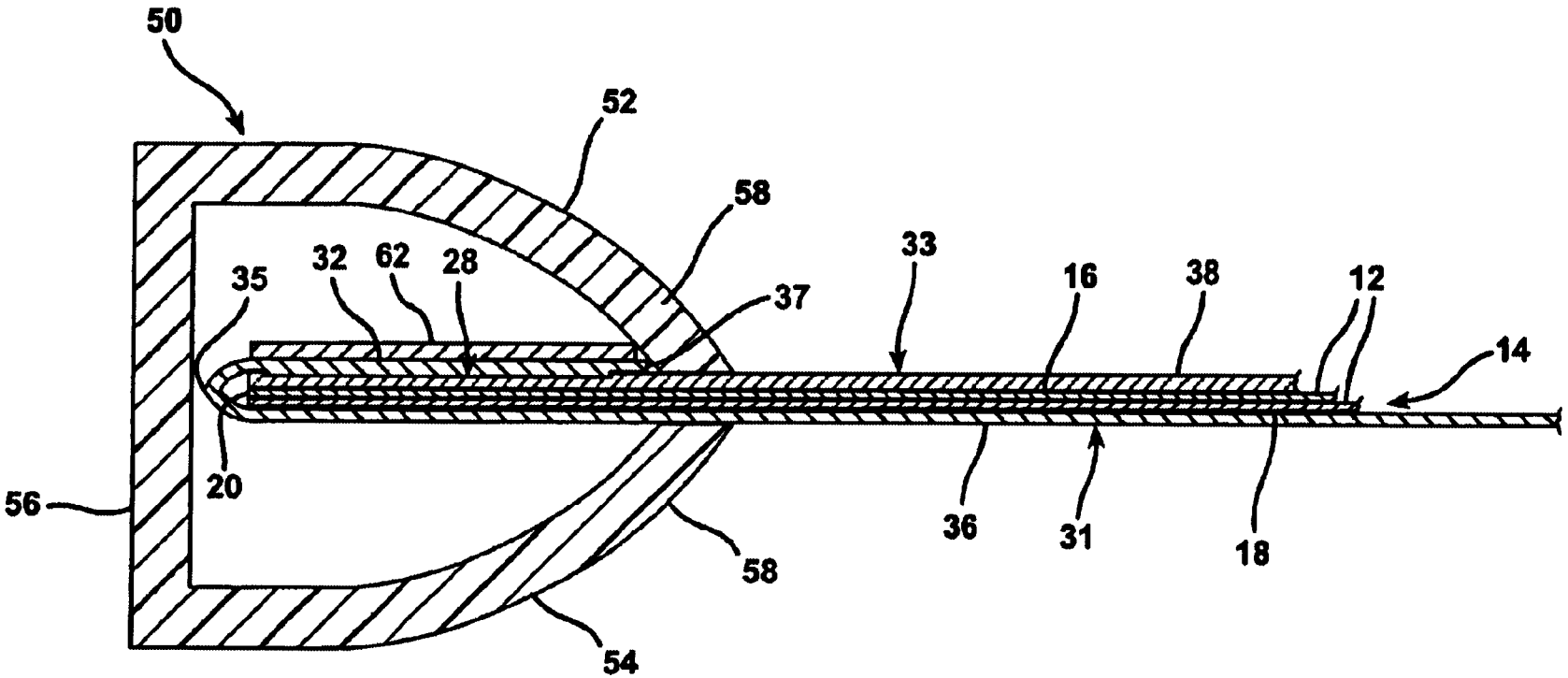
FIG. 4 illustrates an alternative embodiment of the invention to that shown in FIG. 3.

FIG. 4 illustrates an alternative embodiment of the invention in which an elongated, narrow binder reinforcement strip 62 is disposed atop and permanently secured throughout its length to the narrow binding margin panel 32 by sonic welding or adhesive. The binder reinforcing strip 62 is substantially coextensive with the narrow binding of the margin panel 32 and is sealed to the panel 32 throughout its surface of contact therewith. The edge of the margin reinforcement strip 62 furthest from the binding edge 20 of the stack 14 preferably resides directly atop or immediately adjacent to the boundary demarcation edge 37 of the narrow binding margin panel strip 32. The binder reinforcing strip 62 thereby resides in abutment against the distal tip 58 of the jaw 52, as does the boundary demarcation edge 37 of the narrow binding margin panel 32. The binder reinforcing strip 62 thereby aids in preventing forces acting perpendicular to the alignment of the clasp 50 from pulling the pages 12 or the binder cover 30 out from between the clamping distal tips 58 of the clamping jaws 52 and 54.

Figure 5:
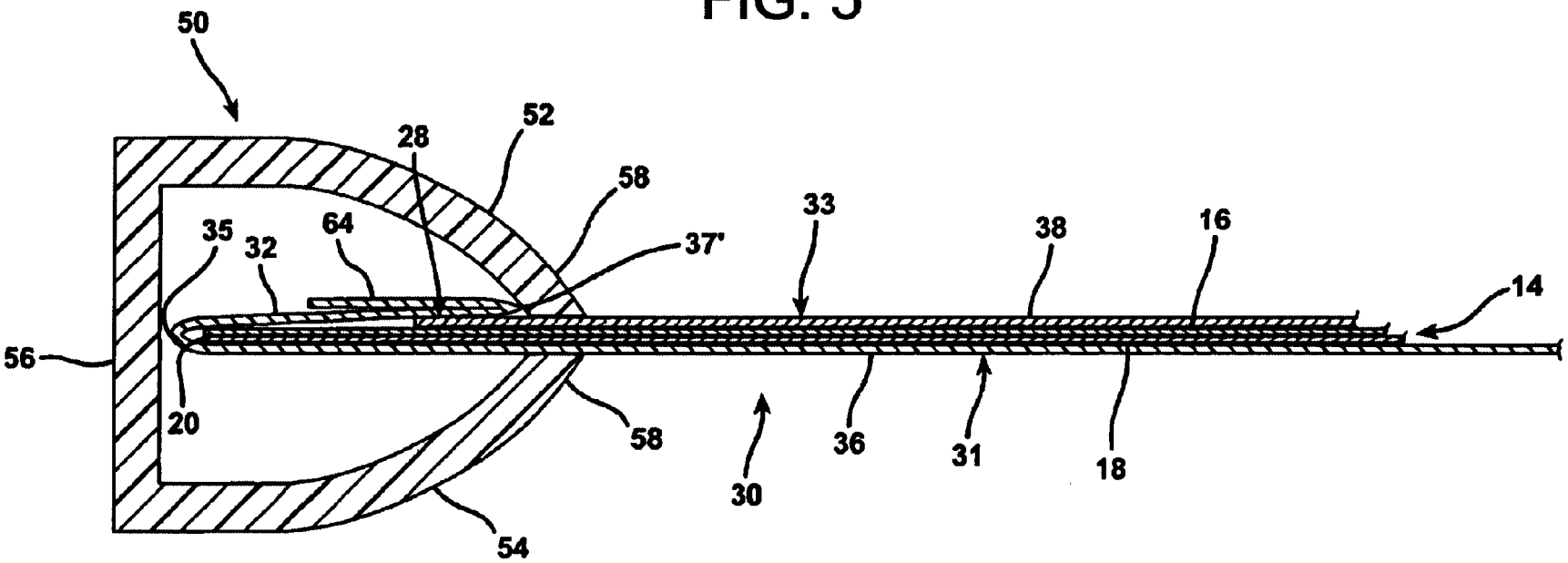
FIG. 5 illustrates another alternative embodiment of the invention to those shown in FIGS. 3 and 4.

FIG. 5 illustrates a further embodiment of the invention comprising a narrow, return panel 64 that is formed as a part of the first sheet of card stock material that also forms the document bottom back cover panel 36 and the narrow margin panel 32. The return panel 64 is joined to the narrow margin panel 32 by a return fold 37 ' at the boundary of the narrow binding margin panel 32 furthest from the binding edge 20 of the stack 14. The return panel 64 also aids in preventing any lateral slippage of the distal tip 58 of the upper jaw 52 due to opposing forces on the stack of papers 14 or the document binder perpendicular to the longitudinal binding edge 20 of the stack 14. The return panel 64 can be secured by adhesive or sonic welding to the underlying narrow margin panel 32, or it can be left unsealed as illustrated in FIG. 5.

Undoubtedly, numerous variations and modifications of the invention will become readily apparent to those familiar with office products. For example, the clasp 50 will engage the top panel 32 whether or not a reinforcement strip 62 or return panel 64 is present in the structure of the document binder 38. In such an embodiment the cut edge 37 of the narrow top cover panel 32 will still be captured in secure locking engagement against the distal tip 58 of the upper jaw 52, as shown in FIG. 3. Also, the system will still provide a positive interlocking engagement if the narrow binding margin panel at the binding margin 28 lies adjacent the bottom sheet 18, rather than the top sheet 16. In such a construction the front cover panel and the narrow binding margin panel are formed of a first sheet of material separate from a second sheet of material that forms the bottom cover. In such a situation it is the distal tip 58 of the lower jaw 54 that will lodge against the inboard edge of the narrow binding margin panel 32. In this construction the bottom cover panel should be considered to be the front cover panel and the top cover panel should be considered to be the back cover panel. Other variations in construction of the combination of the invention are also possible and are still within the concept of the invention envisioned. Accordingly, the scope of the invention should not be construed as limited to the specific embodiments depicted and described, but rather is defined in the claims appended hereto.

I claim:

1. In combination, a plurality of sheets of paper disposed one atop another to form a stack having top and bottom sheets and defining a binding edge of said stack, an opposite edge of said stack parallel to said binding edge, and a narrow binding margin on said stack adjacent to said binding edge;

a document cover formed of a plurality of panels including a front cover panel located atop said stack above said top sheet and a back cover panel located beneath said stack and residing below said bottom sheet and having a margin portion located beneath said binding margin, and wherein another of said document cover panels is a narrow margin binding panel having a width no greater than the width of said binding margin of said stack and said front cover panel is formed of a separate sheet of material from said back cover panel and said narrow margin binding panel, and overlaps and is permanently secured to said narrow margin binding panel; and a stiff, resilient, elongated channel-shaped clasp of uniform cross section throughout formed with a pair of clamping jaws joined together and projecting outwardly from their junction to form distal tips that define a gap therebetween, and said jaws are oriented in opposition relative to each other and said distal tips are directed toward each other to form an angle therebetween of at least about forty-five degrees, and said binding edge of said stack, said narrow margin binding panel, and said margin portion of said back cover panel are inserted in between said jaws with the remainder of said stack and document cover projecting through said gap so that said distal tip of one of said jaws is engaged with said narrow margin binding panel to restrict relative movement between said clasp and said stack in a direction perpendicular to said binding edge.

2. A combination according to claim 1 wherein said jaws of said clasp are oriented relative to each other at an angle of about ninety degrees.

3. A combination according to claim 1 wherein said document cover is further comprised of a binding return panel formed from the same sheet of material as said back cover panel and said marrow margin binding panel and is joined to said narrow margin binding panel at a return fold and projects from said return fold back toward said binding edge of said stack, thereby at least partially covering said narrow margin binding panel.

4. A combination according to claim 1 wherein said gap has a width of no greater than about fifty mils between said distal tips of said jaws when said clasp is in an undeformed condition.

5. A combination according to claim 1 wherein said narrow margin binding panel contacts said front cover panel and is permanently secured thereto throughout its length, and said back cover panel is a broad back cover that extends from said binding edge of said stack all the way across to said opposite edge of said stack beneath said bottom sheet thereof.

6. A combination according to claim 1 further comprising a separate, binder reinforcing strip disposed atop and permanently secured throughout its length to said narrow margin binding panel.

7. A combination according to claim 1 wherein said clasp is formed of polypropylene and has a narrow spine strip from which both of said jaws project in spaced relationship relative to each other.

8. A combination according to claim 7 wherein said narrow spine strip of said clasp has a width at least ten times as great as that of said gap.

9. A combination according to claim 1 wherein said narrow margin binding panel overlaps and is secured by adhesive to said front cover panel.

10. A combination according to claim 1 wherein said narrow margin binding panel overlaps and is secured by heat sealing to said front cover panel.

11. In combination, a plurality of pages disposed one atop another to form a stack having top and bottom sheets and defining a binding edge of said stack, an opposite edge of said stack parallel to said binding edge, and a narrow binding margin on said stack adjacent to said binding edge, a cover for said stack including a first sheet of material forming a margin panel and a back cover panel respectively residing in contact with said top and bottom sheets of said stack and joined together by at least one spine fold located at and parallel to said binding edge of said stack, and said narrow margin panel has an exposed side and an underside and said narrow margin panel extends the length of said binding margin and is limited in width so that it extends no further toward said opposite edge of said stack than said binding margin and thereby defines an inboard boundary proximate said binding margin, and a second sheet of material forming a front cover panel that is permanently secured to said underside of said narrow margin panel, and a stiff, resilient, elongated clasp of uniform cross section throughout and formed as a channel-shaped structure having a pair of opposing jaws that have mutually facing distal tips oriented in opposition relative to each other and which form an angle therebetween of at least about forty-five degrees and which also define a slot opening therebetween, and said distal tip of one of said jaws is disposed to capture said cover therewithin, whereby said distal tip of said one of said jaws engages said inboard boundary of said margin panel, thereby holding said clasp on said binding edge of said stack.

12. A combination according to claim 11 wherein said distal tips of said jaws of said clasp are oriented at an angle of about ninety degrees relative to each other.

13. A combination according to claim 11 wherein said gap has a width of no greater than about fifty mils when said clasp is in an undeformed condition.

14. A combination according to claim 13 wherein said clasp is further comprised of a narrow spine strip from which said jaws project, and said spine strip has a width at least ten times that of said gap.

15. A combination according to claim 11 wherein said binding is further comprised of the narrow return panel that is joined to said narrow margin panel by a return fold at said boundary, and said return panel extends from said boundary across said narrow margin panel back toward said binding edge of said stack.

16. A combination according to claim 11 wherein said clasp is formed of extruded plastic.

17. In combination, a plurality of sheets of paper disposed one atop another to form a stack having top and bottom sheets and defining a binding edge of said stack, an opposite edge parallel to said binding edge, and a narrow binding edge margin on said stack adjacent to said binding edge, a document cover including a front cover panel located atop said stack and residing in contact with said top sheet at said binding margin of said stack and a separate sheet of material forming a back cover panel that extends beneath said stack and which also forms a margin binding strip which is delineated from said back cover panel by at least one spine fold, and said margin binding strip overlaps and is permanently secured to said front cover panel, and is as narrow as said binding margin and terminates in a longitudinal binding margin demarcation above said front cover panel and adjacent said narrow binding margin and parallel to said binding edge of said stack, an elongated document binder clasp configured as a stiff, resilient, channel-shaped structure having a pair of mutually facing jaws with distal tips oriented relative to each other at an angle of no less than about forty-five degrees and which define a gap therebetween, and wherein said binder clasp encompasses said binding edge of said stack and said margin binding strip of said cover in said gap and between said jaws so that said distal tip of one of said jaws engages said binding margin demarcation throughout the length of said binding margin.

18. A combination according to claim 17 wherein said distal tips of said jaws are oriented relative to each other at an angle of about ninety degrees.

19. A combination according to claim 17 wherein said clasp is further comprised of a narrow, spine strip from which said jaws project and said spine strip of said clasp has a width at least ten times the width of said gap.

20. A combination according to claim 17 wherein said top binding strip is secured throughout its length by adhesive to said top front cover panel.

* * * * *